US006776350B2

(12) United States Patent
Sumida et al.

(10) Patent No.: US 6,776,350 B2
(45) Date of Patent: Aug. 17, 2004

(54) REMOTE CONTROLLER FOR AIR CONDITIONER AND AIR CONDITIONER

(75) Inventors: Hisashi Sumida, Osaka (JP); Mitsuhiko Yamamoto, Osaka (JP)

(73) Assignee: Daiken Industries, Ltd., Osaka (JP)

( * ) Notice: Subject to any disclaimer, the term of this patent is extended or adjusted under 35 U.S.C. 154(b) by 8 days.

(21) Appl. No.: 10/168,012

(22) PCT Filed: Oct. 17, 2001

(86) PCT No.: PCT/JP01/09126

§ 371 (c)(1),
(2), (4) Date: Jun. 18, 2002

(87) PCT Pub. No.: WO02/33328

PCT Pub. Date: Apr. 25, 2002

(65) Prior Publication Data

US 2002/0178740 A1 Dec. 5, 2002

(30) Foreign Application Priority Data

Oct. 19, 2000 (JP) ..... 2000-318858

(51) Int. Cl.[7] ..... F24F 11/02
(52) U.S. Cl. ..... 236/51; 236/94; 62/126
(58) Field of Search ..... 236/51, 49.3, 94; 62/126, 127, 129, 130, 161, 163; 165/11.1

(56) References Cited

U.S. PATENT DOCUMENTS 5,725,148 A * 3/1998 Hartman ..... 236/49.3
6,241,156 B1 * 6/2001 Kline et al. ..... 236/49.3
6,260,765 B1 * 7/2001 Natale et al. ..... 236/47
6,286,764 B1 * 9/2001 Garvey et al. ..... 236/12.12

FOREIGN PATENT DOCUMENTS

| | | |
|---|---|---|
| JP | 4-187934 | 7/1992 |
| JP | 5-263558 | 10/1993 |
| JP | 8-54142 | 2/1996 |
| JP | 10-232044 | 9/1998 |
| JP | 11-232459 | 8/1999 |
| JP | 2000-146267 | 5/2000 |

* cited by examiner

*Primary Examiner*—Harry B. Tanner
(74) *Attorney, Agent, or Firm*—McDermott Will & Emery LLP

(57) ABSTRACT

The present invention relates to an air conditioner and a remote controller for the air conditioner, and aims at inhibiting a remote controller operation by a person other than a specific user. Therefore, the specific user previously operates an operation button 30 thereby inputting a set password 41 or the like with respect to a remote controller 1. A CPU 10 stores the input set password 41 or the like in a memory 40. When setting of the set password 41 or the like is carried out, the CPU 10 displays the purport that the remote controller is in a locked state on a display part 20. Even if a remote controller operation related to operation setting of the air conditioner is carried out, the CPU 10 invalidates the operation contents unless input of an input password or the like matching with the set password 41 or the like is performed.

4 Claims, 15 Drawing Sheets

REMOTE CONTROLLER FOR AIR CONDITIONER AND AIR CONDITIONER

TECHNICAL FIELD

The present invention relates to a remote controller for an air conditioner for changing or monitoring a set state of a preset temperature or the like in the air conditioner and an air conditioner comprising the remote controller.

BACKGROUND TECHNIQUE

A conventional air conditioner is structured in a state where an indoor unit and a remote controller (hereinafter simply referred to as "remote controller") are communicable, and structured to be capable of remotely setting set contents of an operating state for air conditioning by the indoor unit or an outdoor unit from the remote controller.

However, there is such a problem that it becomes difficult to manage proper air conditioning when setting the remote controller in a state operable by anybody. When a remote controller is set every classroom in a school, for example, different setting may be performed every classroom, and it becomes difficult to manage controlled air conditioning in the overall school.

In order to solve such a problem, problem solution has generally been carried out on a component part other than the remote controller by inhibiting each remote controller from set operation from a centralized controller or storing the remote controller in a keyed box, for example.

DISCLOSURE OF THE INVENTION

The present invention has been proposed in consideration of the aforementioned problem, and aims at proposing a remote controller for an air conditioner capable of inhibiting the single remote controller from operation by a person other than a specific user.

A first mode of the remote controller for an air conditioner according to the present invention comprises storage means (40) storing identification information (41, 43, 44, 45) and control means (10) validating operational input related to operation setting of the said air conditioner only when information matching with the said identification information is input. Thus, it becomes possible to inhibit the single remote controller from remote controller operation by a person other than the specific user.

A second mode of the remote controller for an air conditioner according to the present invention further comprises operation means (30) for inputting the said information, and the said identification information is a previously stored set password (41) in the first mode. Thus, the specific user is enabled to arbitrarily set identification information unknown to others.

A third mode of the remote controller for an air conditioner according to the present invention is characterized in that the said set password (41) is input from the said operation means, and it further comprises display means (20) displaying the said set password on that occasion in the second mode. Thus, the specific user is enabled to readily set a desired password.

A fourth mode of the remote controller for an air conditioner according to the present invention is characterized in that the said control means (10) displays the purport that password setting is carried out with respect to the said display means (20) when the said set password (41) is stored in the said storage means in the third mode. Thus, it is possible to readily grasp that the remote controller for an air conditioner is in a locked state.

A fifth mode of the remote controller for an air conditioner according to the present invention is characterized in that the said control means (10) switches the display contents in the said display means (20) from the display contents of the purport that the said password setting is carried out to general display contents for operational input when operational input of a password matching with the said set password (41) is performed in the fourth mode. Thus, operability at the same when the specific user operates the remote controller for an air conditioner improves.

A sixth mode of the remote controller for an air conditioner according to the present invention is characterized in that the said control means (10) switches the display contents in the said display means (20) from the said general display contents to the display contents of the purport that the said password setting is carried out when a prescribed time has elapsed from final operational input after switching the display contents in the said display means (20) to the said general display contents in the fifth mode. Thus, after the specific user operates the remote controller for an air conditioner, it is possible to prevent others from performing operation.

A seventh mode of the remote controller for an air conditioner according to the present invention further comprises image input means (70) inputting an image in the first mode, and the said control means (10) validates operational input related to operation setting of the said air conditioner only when the said image input from the said image input means matches with the said identification information in the first mode. Thus, the specific user may not keep the identification information in mind.

An eighth mode of the remote controller for an air conditioner according to the present invention is a remote controller for an air controller characterized in that the said image input means (70) input an image of a characteristic part in a human body in the seventh mode. Thus, the remote controller for an air conditioner can specify the specific user.

A ninth mode of the remote controller for an air conditioner according to the present invention further comprises a card reader (80) reading the said information from a card assigned with the said information, and the said control means (10) validates the operational input related to the operation setting of the said air conditioner only when the said information input from the said card reader matches with the said identification information in the first mode. Thus, it becomes possible to perform locking and unlocking of the remote controller so far as the specific user possesses the card.

A tenth mode of the remote controller for an air conditioner according to the present invention further comprises voice input means (90) inputting a voice and generating a voice signal, and the said control means (10) validates the operational input related to the operation setting of the said air conditioner only when the said voice signal input from the said voice input means matches with the said identification information in the first mode. Thus, the specific user is enabled to perform locking and unlocking of the remote controller by simply uttering the voice him(her)self.

The present invention also aims at providing an air conditioner capable of inhibiting a single remote controller from operation by a person other than a specific user.

The mode of the air conditioner according to the present invention is structured while comprising the remote controller for an air conditioner in any one mode of the first to tenth of the aforementioned remote controller for an air conditioner. Thus, it is possible to implement an air conditioner capable of inhibiting the single remote controller from remote controller operation by a person other than the specific user.

The objects, features, aspects and advantages of the present invention will become more apparent from the following detailed description and the accompanying drawings.

BEST MODES FOR CARRYING OUT THE INVENTION

Embodiments of the present invention are now described in detail with reference to the drawings.

<First Embodiment>

First, a first embodiment is described. In this embodiment, a structure capable of changing/operating an operating state of an air conditioner with a remote controller by operation of a specific user inputting a previously set password.

Figure 1:
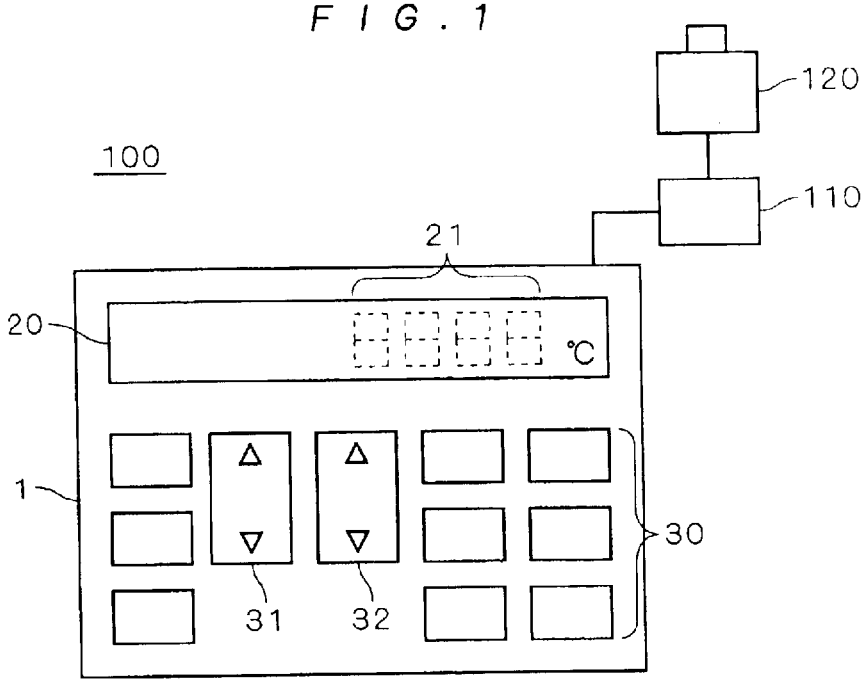
FIG. 1 is a diagram showing an air conditioner in a first embodiment.

FIG. 1 is a diagram showing an air conditioner 100 in the first embodiment. The air conditioner 100 comprises a remote controller 1, an indoor unit 110 and an outdoor unit 120, and is structured to be capable of remotely setting set contents of an operating state for air conditioning by the indoor unit 110, the outdoor unit 120 or the like from the remote controller 1. Therefore, the remote controller 1 is structured to be capable of making data communication with the indoor unit 110 or the outdoor unit 120 by wire or radio, while the indoor unit 110 and the outdoor unit 120 perform operation based on the set contents set from the remote controller 1. FIG. 1 illustrates a case where the remote controller 1 is cable-connected with the indoor unit 110 so that the remote controller 1 and the indoor unit 110 make data communication.

In order to improve operability of remote manipulation in the remote controller 1, a display part 20 is provided on the upper side of the front face of the remote controller 1, and a plurality of operation buttons 30 are arranged on the lower side.

The display part 20 in the remote controller 1 is provided with a numerical display part 21 formed by 7-segment indicators, for example, to be capable of displaying a numerical value of about eight digits. FIG. 1 illustrates four digits.

Figure 2:
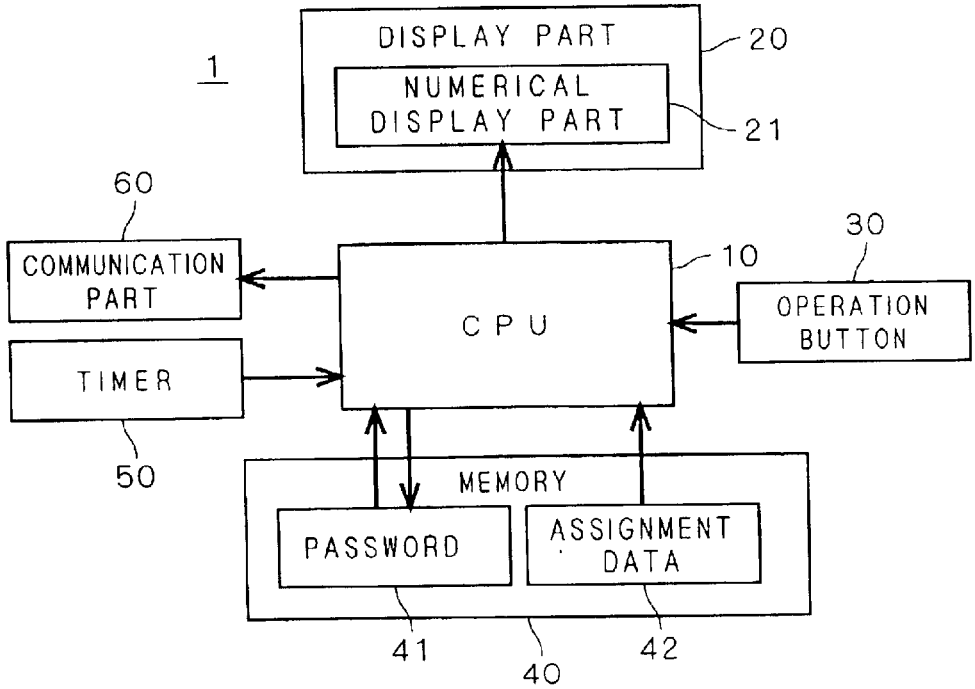
FIG. 2 is a block diagram showing the internal structure of a remote controller in the first embodiment.

FIG. 2 is a block diagram showing the internal structure of the remote controller 1. The remote controller 1 is structured while comprising a CPU 10, the display part 20, the operation buttons 30, a memory 40, a timer 50 and a communication part 60.

The CPU 10 has a function of setting a password, while having a function of making it impossible to perform set changing operation for the operating state etc. of the air conditioner 100 without inputting the password when the password is set.

When proper input of the password is performed in a case where the password is set, on the other hand, it follows that the CPU 10 accepts the set changing operation for the operating state etc. of the air conditioner 100 as a valid one, and performs control operation of the air conditioner 100 such as that transmitting a control signal corresponding to the operated operation button 30 to the indoor unit 110 or the like.

That is, when operational input related to operation setting of the air conditioner 100 is performed, the CPU 10 functions as control means determining whether to validate or invalidate the aforementioned operation setting by determining whether or not there has been input of a password matching with the set password.

The CPU 10 is structured to control display contents on the display part 20 while obtaining input information from the operation button 30 operated by the user or the like. Further, the CPU 10 is structured to be capable of acquiring data related to the operational situation or the like from the indoor unit 110 or the like through the communication part 60, and has functions of making the display part 20 display the operational situation or the like of the air conditioner 100 while transmitting a control signal for making operation setting or the like with respect to the indoor unit 110 or the like. When the password is set on the remote controller 1 and the password (set password) set on the remote controller 1 and a password (input password) input in remote controller operation do not match, however, the CPU 10 transmits no control signal to the indoor unit 110 or the like.

The memory 40 is that for storing data in the remote controller 1, and defines storage means storing a set password 41 set on the remote controller 1 and assignment data 42 individually assigning numerical values to the plurality of operation buttons 30. Data reading/writing of the memory 40 is controlled by the CPU 10.

The timer 50 has a function of supplying a timer signal for time counting to the CPU 10. Thus, the CPU 10 can count an elapsed time from arbitrary timing. The communication part 60 has a function of making data communication with the indoor unit 110 or the like, and supplies data obtained from the indoor unit 110 or the like to the CPU 10 while transmitting data from the CPU 10 to the indoor unit 110 or the like.

In the remote controller 1, the CPU 10 sets an arbitrary numerical value of four digits, for example, as the set password. In general, the remote controller 1 is not provided with operation buttons such as ten keys dedicated to numerical input. Data for assigning different numerals to the respective ones of the plurality of operation buttons 30 are stored in the assignment data 42, and the CPU 10 refers to the assignment data 42 when the operation button 30 is pushed thereby specifying a single numerical value corresponding to its button signal. So that one of the plurality of operation buttons 30 functions as a definite button defining the password of four digits, data therefor is stored in the assignment data 42.

For example, two up-down buttons 31 and 32 are provided for the plurality of operation buttons 30 in the remote controller 1 shown in FIG. 1, and the number of the operation buttons 30 in the remote controller 1 is 13 when including operating parts on upper and lower two portions of these up-down buttons 31 and 32. Numerical values of 0 to 9 are assigned to 10 operation buttons 30 among these, and a single operation button 30 is assigned as the definite button. The assignment data 42 indicating such association between the respective operation buttons 30 and the numerical values are previously stored in the memory 40.

When the number of the operation buttons 30 provided on the remote controller 1 is less than 11, nut the 10 numerical values of 0 to 9 are assigned but numerical values of less than 10 may be assigned. When the number of the operation buttons 30 is only seven, for example, one of the seven operation buttons 30 may be regarded as the definite button and the six numerical values of 0 to 5 may be assigned to the respective ones of the remaining six operation buttons 30.

When referring to the assignment data 42 stored in the memory 40 on the basis of the button signal at the time when the operation button 30 is operated, the CPU 10 can specify the numerical value corresponding to the button.

The CPU 10 thus specifies the numerical value with the assignment data 42, whereby each operation button 30 can implement different input functions at a password input time and a remote controller operation time, and it becomes possible to also perform numerical input by simply providing the minimum operation buttons 30 merely exhibiting general remote controller functions such as temperature change on the remote controller 1. Thus, it is not necessary to provide a specific operation button dedicated to numerical input on the remote controller 1.

Operation of performing printing of the numerical value previously assigned in the aforementioned manner on the button of each operation button 30 shown in FIG. 1 or on a proximity position of each operation button 30 is preferable in such a point that the user can perform operational input while visually recognizing the relation between each operation button 30 and the numerical value on the occasion of performing input operation of the password.

Figure 3:
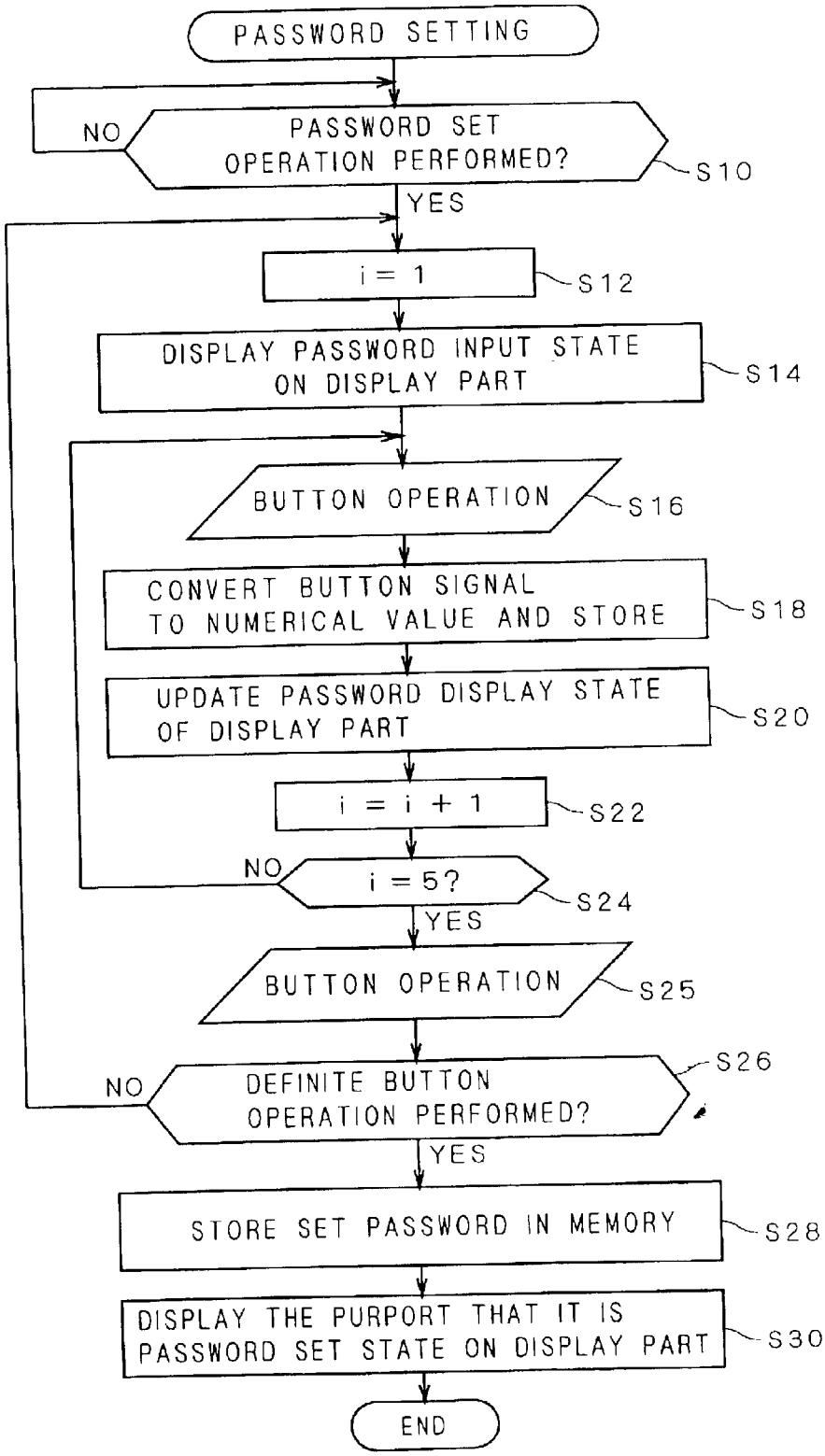
FIG. 3 is a flow chart showing a procedure on the occasion of setting password setting.

A procedure in a case of setting the set password on the remote controller 1 is now described. FIG. 3 is a flow chart showing the procedure on the occasion of setting the password setting.

First, the CPU 10 determines whether or not specific operation for setting the password on the remote controller 1 has been performed (step S10). It is desired that this specific operation is operation, such that a plurality of specific operation buttons 30 are simultaneously continuously pressed for several seconds, for example, not carried out in general operation.

When no specific operation is performed, it does not advance to processing for setting the password. When the password is not set on the remote controller 1, it follows that the remote controller 1 performs operation similar to that of a general remote controller, and a person other than the specific user can perform remote controller operation for changing operation setting or the like of the air conditioner 100.

When the specific operation is performed, on the other hand, the CPU 10 initializes digit information i of the password to 1 (step S12), while displaying the input state of the password on the display part 20 (step S 14).

At this time, the CPU 10 makes the numerical value display part 21 function as display means for password confirmation, and makes a first-digit 7-segment indicator blink. Thus, the user can visually recognize that it is an input stage of the first-digit password.

Then, the user operates an arbitrary button among the plurality of operation buttons 30 (step S16). The CPU 10 converts the button signal for the operated button to a numerical value on the basis of the assignment data and temporarily stores the same (step S18). Then, it displays the converted numerical value on a digit part of the numerical value display part 21 defining an input object and shifts the blinking to a next digit, thereby updating the password display state of the display part 20 (step S20). Then, it increments the digit information i by 1 (step S22).

The CPU 10 determines whether or not the digit information i has reached 5 (step S24). If the digit information i has reached 5, it follows that input of all digits forming the password has been performed and hence it advances to a step S25 and accepts input operation of the operation button 30. If the digit information i is less than 5, on the other hand, all input has not yet been performed and hence it repeats the processing from the step S116 for performing password input of the remaining digit parts. It follows that the processing at the steps S16 to S22 is repeated four times in total, whereby password input of four digits terminates.

The CPU 10 determines whether or not the operation button 30 operated at the step S25 is a button corresponding to the definite button (step S26). That is, the CPU 10 makes determination as to whether or not the operation button 30 subsequently operated after the password input of the four digits has been performed is the button assigned to the assignment data 42 as the definite button, thereby determining whether or not to perform setting of the password. The user can determine whether or not it has been possible to input the desired password when visually recognizing the four-digit display of the numerical value display part 21, and hence comes to press the operation button 30 corresponding to the definite button if the desired password is displayed. When the CPU 10 determines that operation of the definite button has not been performed, it returns to the step S12 and makes transition to set input of the password again. When operation of the definite button has not been performed, the processing of password setting may be terminated without storing the input password.

When operation of the definite button has been performed, on the other hand, the CPU 10 stores the defined password of four digits in the memory 40 as the set password 41 to be set on the remote controller 1 (step S28). Thus, it follows that the set password is set on the remote controller 1. The CPU 10 displays the purport that it is a state where the password is set on the remote controller 1 (password set state) with respect to the numerical value display part 21 (step S30). This display is performed in some display mode capable of recognizing that password setting such as "PASS" is performed with the 7-segment indicators for four digits, for example. Thus, the user can recognize that the password is set on the remote controller 1, and can grasp that it is a locked state where remote controller operation by a person other than the specific user is inhibited.

Thus, setting of the password on the remote controller 1 terminates.

Figure 4:
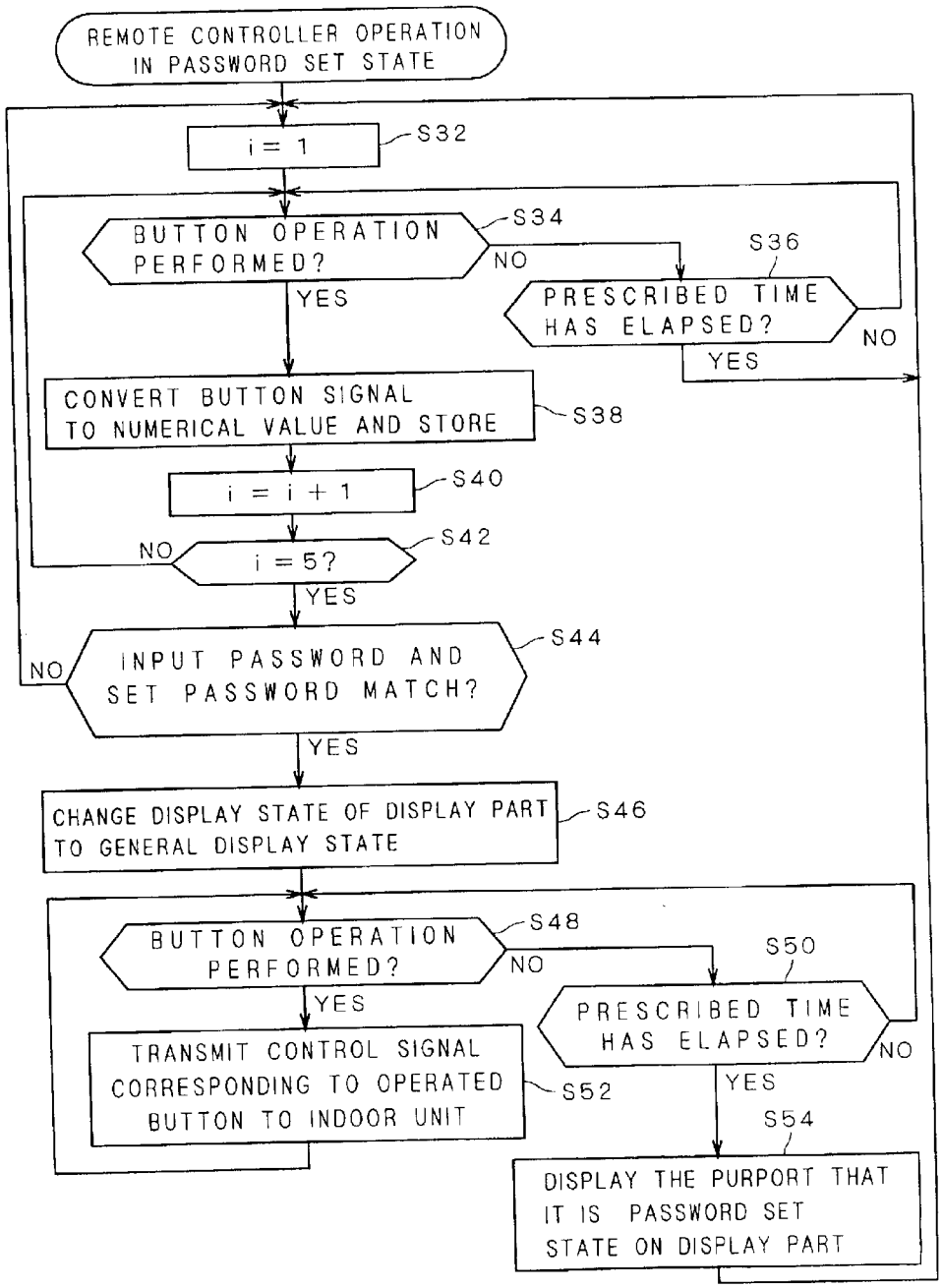
FIG. 4 is a flow chart showing a procedure in a password set state.

A procedure in the case of performing remote controller operation in the password set state is now described. FIG. 4 is a flow chart showing the procedure in the password set state.

When shifting to the password set state, the CPU 10 first initializes the digit information i to 1 (step S32). Then, it determines whether or not button operation has been performed (step S34), for advancing to a step S38 when the button operation has been performed while advancing to a step S36 when no operation has been performed.

When there is no button operation at the step S34 and it advances to the step S36, the CPU 10 determines whether or not a prescribed time has elapsed (step S36). More specifically, the CPU 10 counts the timer signal supplied from the timer 50 and determines whether or not a prescribed time of about several seconds has elapsed from the time when the operation button 30 was finally operated. Determining the elapsed time from the final button operation, the CPU 10 resets counting of the timer signal every time the button operation is performed.

It returns to the step S34 when the prescribed time has not yet elapsed and enters enter a standby state for button operation for continuous input of the password, while it returns to the step S32 when the prescribed time has elapsed and enters a button operation standby state from the first digit of the password.

At the step S38, the CPU 10 refers to the assignment data 42 of the memory 40 thereby converting the button signal obtained from the operated operation button 30 to a numerical value and temporarily stores the numerical value (step S38). It follows that numerical input for one digit has been performed in this case, and hence it increments the digit information i by 1 for shifting the input digit to a next digit (step S40).

Then, the CPU 10 determines whether or not the digit information i has reached 5 (step S42). If the digit information i is less than 5, it follows that all digit input forming the password does not terminate and hence it returns to the step S34 in this case to enter a standby state for subsequent digit input. The processing at the steps S34, S38 and S40 is repeated four times, whereby it follows that the digit information i reaches 5 and input of all digits of the password is performed.

When input of all digits terminates, the CPU 10 reads the set password 41 from the memory 40, and makes determination as to whether or not the input password input by repetition of the steps S34, S38 and S40 matches with the set password (step S44). When the input password and the set password do not match here, it returns to the step S32 to enter the input standby state for the password again while the locked state is maintained.

When the input password and the set password match, on the other hand, it can be estimated that the operator of the remote controller 1 is the specific user knowing the set password, and hence it advances to a step S46 to enter an unlocked state for enabling general remote controller operation.

The CPU 10 switches the display state of the display part 20 from the display of the password set state to display for the general remote controller operation (step S46). Thus, the specific user can properly perform operation setting etc. of the air conditioner 100 while visually recognizing the display part 20. Then, it advances to a step S48 and determines whether or not button operation has been performed. It advances to a step S52 when button operation has been performed, and advances to a step S50 when no operation has been performed.

At the step S52, the CPU 10 generates a control signal corresponding to the operated operation button 30 and performs communication with the indoor unit 110 or the like, thereby validating the contents of operation setting by remote controller operation such as change of the preset temperature in the air conditioner 100. When operation setting etc. responsive to the button operation is performed, it comes to return to the step S48 again.

When no button operation has been performed in the determination at the step S48, it advances to the step S50 and the CPU 10 determines whether or not the prescribed time has elapsed. This processing is similar to the processing at the step S36, and the CPU 10 counts the timer signal supplied from the timer 50 and determines whether or not the prescribed time has elapsed from the time when the operation button 30 was finally operated. It returns to the step S48 and enters a standby state for subsequent button operation when the prescribed time has not yet elapsed, while it returns to a step S54 and switches the display state in the display part 20 to the display state of the purport that it is the password set state when the prescribed time has elapsed, thereafter returns to the step S32 to enter the locked state by the password again, and enters a button operation standby state for input of the password.

Also when the input password and the set password match, therefore, it follows that the CPU 10 automatically returns to the locked state by the password if the user performs no button operation over the prescribed time. Even if the specific user properly inputs the input password, performs button operation for operation setting of the air conditioner 100 with the remote controller 1 and thereafter leaves the remote controller 1 in this state, therefore, it is possible to prevent the set contents from being changed by another person.

When employing the aforementioned remote controller 1, it is possible to set the password on the remote controller 1 itself, it is possible to inhibit a person other than the specific user from changing the operating state of the air conditioner 100 by operating the remote controller 1, and it becomes possible to perform controlled air conditioning management.

While the example of setting the password as the numerical value of four digits has been described in the above description, it is not restricted to this but each operation button 30 may be assigned to an arbitrary number of characters or the like. When so structuring it as to set the password with a numerical value, however, it is effective in a point that display means such as the 7-segment indicators provided on an existing remote controller can be utilized as such.

While the example of assigning different numerical values to the respective ones of the respective operation buttons 30 and inputting the password by operating the plurality of operation buttons 30 to which the numerical values are assigned has been shown in the above description, it is also possible to structure it so that the numerical values are updated in ascending order by pressing the up side and the numerical values are updated in descending order by pressing the down side when the up-down buttons 31 and 32 are provided as in FIG. 1. When structuring it in this manner, it is effective in a point that there is no need to assign different numerical values to the respective operation buttons 30, and particularly effective when the number of the operation buttons 30 provided on the remote controller 1 is small.

The password may be secret information such as the so-called personal identification number, or may not be set by the user but be specific to the remote controller.

<Second Embodiment>

A second embodiment is now described. In this embodiment, a structure previously storing feature data of the fingerprint, the eyeball, the face or the like of a specific user to be capable of changing/operating an operating state of an air conditioner by a remote controller when the feature of an image input from an image input part in remote controller operation and the contents of the previously stored feature data match.

Figure 5:
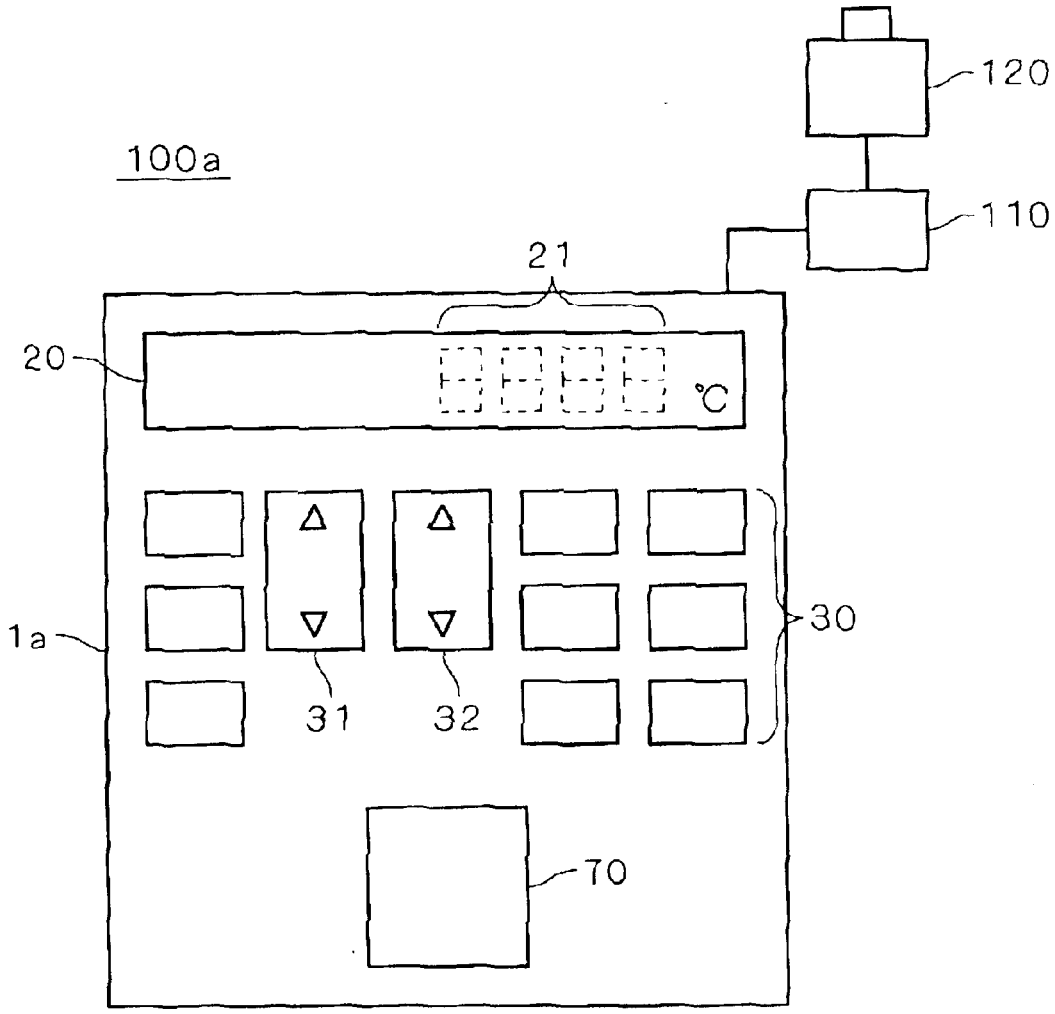
FIG. 5 is a diagram showing an air conditioner in a second embodiment.

FIG. 5 is a diagram showing an air conditioner 100*a* in the second embodiment. The air conditioner 100*a* comprises a remote controller 1*a*, an indoor unit 110 and an outdoor unit 120, and is structured to be capable of remotely setting the set contents of an operating state for air conditioning by the indoor unit 110, the outdoor unit 120 or the like from the remote controller 1*a*.

The remote controller 1*a* has a structure substantially similar to the remote controller 1 in the first embodiment, and the same numerals are assigned as to structural members similar to the structural members described in the first embodiment also in FIG. 5.

The remote controller 1*a* comprises a display part 20 and a plurality of operation buttons 30, and an image input part 70 formed by a scanner or a camera is provided on a lower side of the plurality of operation buttons 30.

Figure 6:
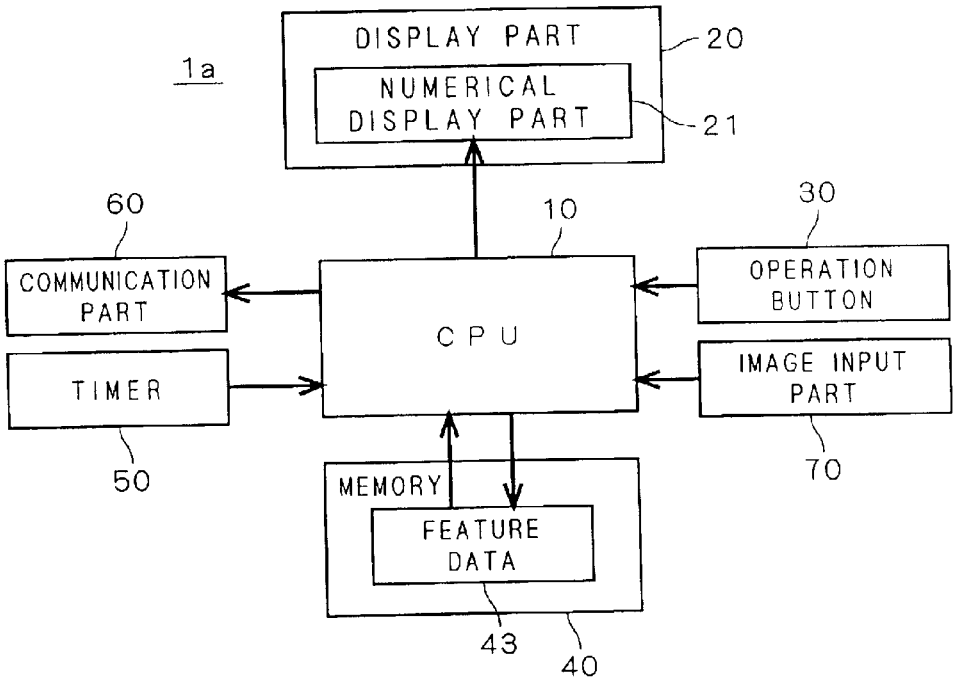
FIG. 6 is a block diagram showing the internal structure of a remote controller in the second embodiment.

FIG. 6 is a block diagram showing the internal structure of the remote controller 1*a*. As shown in FIG. 6, the remote controller 1*a* is structured while comprising a CPU 10, the display part 20, the operation buttons 30, a memory 40, a timer 50, a communication part 60 and the image input part 70.

The image input part 70 performs scanning or photographing when a prescribed operation button 30 is operated, to generate image data related to the user operating the remote controller 1*a*. The image data generated by the image input part 70 is image data related to the fingerprint, the eyeball (particularly the retina or the iris), the face or the like of the user, for example.

The CPU 10 analyzes the image data input from the image input part 70, and feature data responsive to the contents of an input image is generated. In a case of inputting a fingerprint image, for example, feature data responsive to the fingerprint at a degree capable of specifying an individual from the fingerprint image is generated.

The CPU 10 has a function of previously registering feature data 43 related to the specific user, while having a function of making it impossible to perform operation of set changing of the operating state or the like of the air conditioner 100*a* without performing input of an image whose feature matches when the feature data is registered.

When input of an image whose feature matches is performed in a case where the feature data 43 is registered, on the other hand, the CPU 10 accepts operation of set changing of the operating state or the like of the air conditioner 100*a* performed by the user following the image input operation as a valid one and comes to perform control operation of the air conditioner 100*a* such as that transmitting a control signal corresponding to the operated operation button 30 to the indoor unit 110 or the like.

When the feature data 43 is registered in a case where the feature of an image input by the user performing image input operation in remote controller operation does not match with the registered feature data, the CPU 10 does not accept set changing of the operating state or the like of the air conditioner 100*a* input in continuation thereto.

That is, the CPU 10 functions as control means determining whether or not there has been input of an image matching with the registered feature data 43 when operational input related to operation setting of the air conditioner 100*a* is performed, thereby determining whether to validate or invalidate operation setting input in the remote controller 1*a*.

The memory 40 is storage means for registering (storing) the feature data 43 in the remote controller 1*a*. When an image related to the specific user is previously input with respect to the remote controller 1*a*, the CPU 10 analyzes the image to generate the feature data and stores the same in the memory 40, whereby registration of the feature data is performed.

Figure 7:
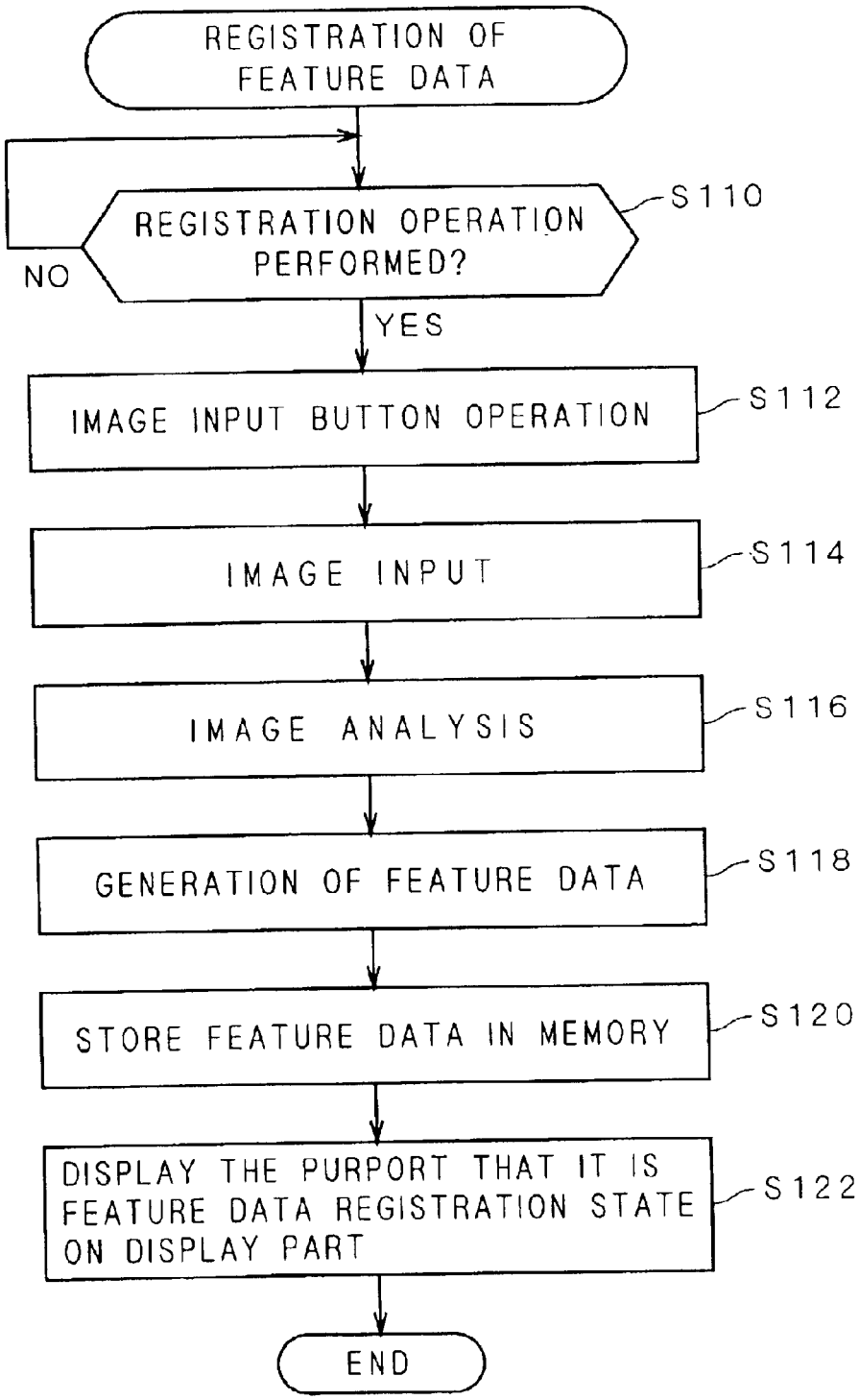
FIG. 7 is a flow chart showing a procedure on the occasion of registering feature data of an image related to a specific user.

A procedure in the case of registering the feature data of the image related to the specific user with respect to the remote controller 1*a* is now described. FIG. 7 is a flow chart showing the procedure on the occasion of registering the feature data of the image related to the specific user.

First, the CPU 10 determines whether or not specific operation for setting the feature data of the image related to the specific user has been performed with respect to the remote controller 1*a* (step S110).

When no specific operation is performed, it does not advance to processing for registering the feature data. When no feature data is set on the remote controller 1*a*, it follows that the remote controller 1*a* performs operation similar to that of a general remote controller, and a person other than the specific user can perform remote controller operation for changing operation setting or the like of the air conditioner 100*a*. When the user operates the remote controller 1*a* in this case, therefore, the CPU 10 generates a control signal responsive to the operation contents and transmits the same to the indoor unit 110 or the like thereby performing operation control of the air conditioner 100*a*.

When the specific operation has been performed, on the other hand, it enters a state waiting for image input from the image input part 70, and when operation of an image input button included in the operation buttons 30 is performed by the user (step S112), it controls scanning operation or photographing operation of the image input part 70 in response thereto and inputs the image data from the image input part 70 (step S114). At this time, the user preferably approaches the part (the fingerprint, the eyeball, the face or the like) of the body defining the object of reading with respect to the image input part 70 to take such a posture that the image input part 70 can properly perform image input.

The CPU 10 analyzes the input image data (step S 116), generates the feature data of the image (step S118), and makes the memory 40 store the feature data (step S120).

Thus, it follows that the feature data 43 has been registered in the remote controller 1*a*, and hence the CPU 10 displays the purport that it is the state where the feature data has been registered with respect to the display part 20 (step 122). This display may be display of the purport that it is a locked state. This display is performed in some display mode such as "LOCK" capable of recognizing that it is a locked state with 7-segment indicators for four digits, for example. Thus, the user can grasp that the feature data is registered in the remote controller 1*a* and it is the locked state where remote controller operation by a person other than the specific user is inhibited.

Registration processing of the feature data in the remote controller 1*a* terminates in the above manner.

Figure 8:
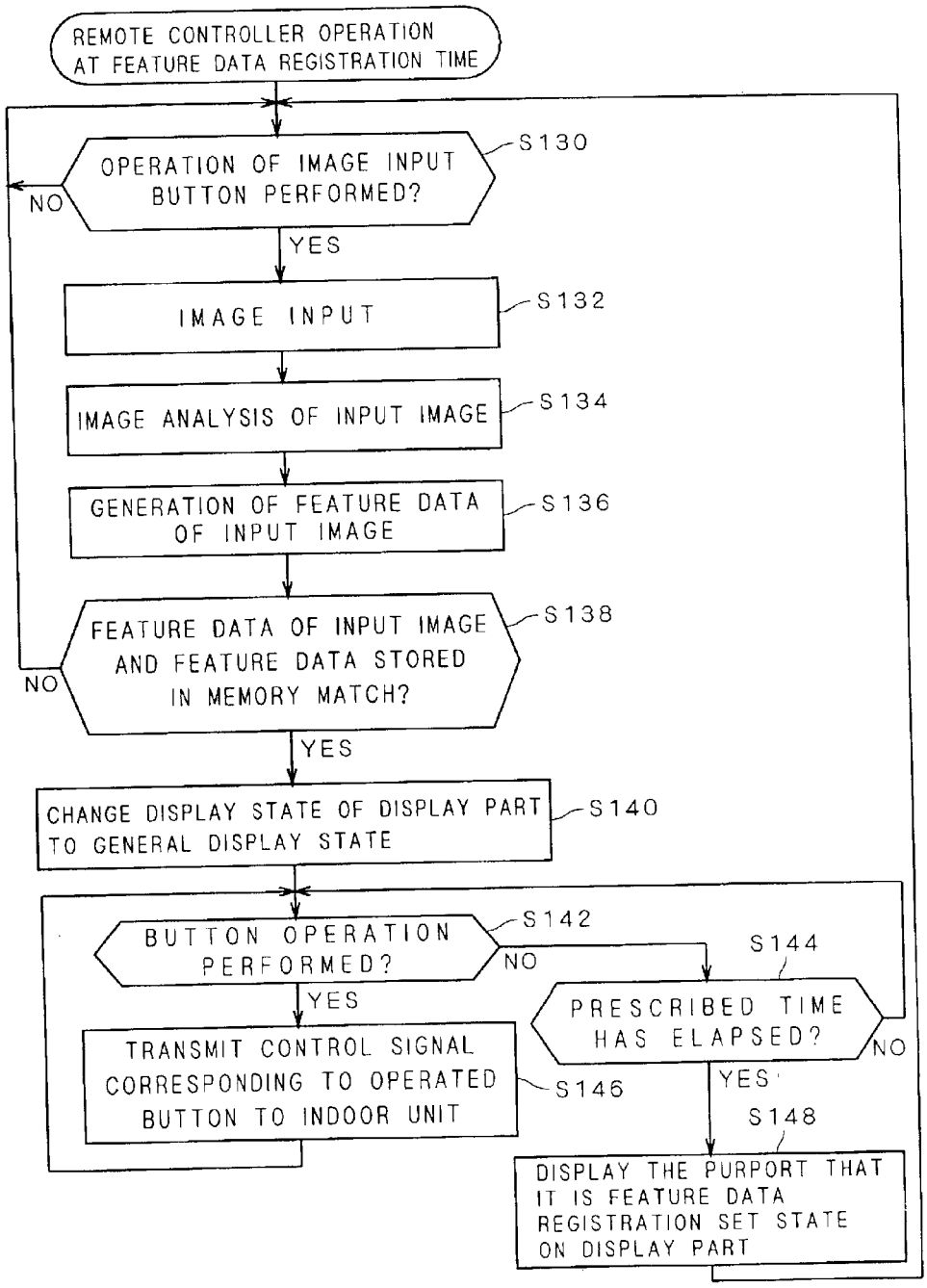
FIG. 8 is a flow chart showing a procedure in a feature data registration state.

A procedure in the case of performing remote controller operation in the feature data registration state is now described. FIG. 8 is a flow chart showing the procedure at the feature data registration time.

When shifting to the state where the feature data is registered, the CPU 10 enters a state waiting for operation of the image input button (step S130), and advances to a step S132 when button operation is performed.

When operation of the image input button is performed by the user, the CPU 10 controls scanning operation or photographing operation of the image input part 70 in response thereto, and inputs the image data from the image input part 70 (step S132). Then, the CPU 10 performs image analysis of the input image (step S134), and generates the feature data of the image (step S136).

Then, the CPU 10 reads the previously registered feature data 43 from the memory 40, and makes determination as to whether or not the feature data of the input image obtained by the step S136 matches with the registered feature data 43 (step S138). When the feature data of the input image and the registered feature data 43 do not match at this point of time, it returns to the step S130 to enter the standby state for the image input again while the locked state is maintained.

When the feature data of the input image and the registered feature data 43 match, on the other hand, it is estimable that the operator of the remote controller 1*a* is the same person as the specific user, and hence it advances to a step S140 for enabling general remote controller operation and enters an unlocked state.

The CPU 10 switches the display state of the display part 20 from the display of the feature data registration state to display for general remote controller operation (step S140). Thus, the specific user can properly perform operation setting or the like of the air conditioner 100*a* while visually recognizing the display part 20. Then, it advances to a step S142, and determines whether or not button operation of the remote controller 1*a* has been performed. It advances to a step S146 when the button operation has been performed, while advancing to a step S 144 when no operation has been performed.

At the step S146, the CPU 10 generates a control signal corresponding to the operated operation button 30 and makes communication with the indoor unit 10 or the like, thereby validating the contents of operation setting by remote controller operation such as change of a preset temperature in the air conditioner 100*a*. When operation setting or the like responsive to the button operation is performed, it comes to return to the step S142 again.

When no button operation has been performed in the determination at the step S142, it advances to the step S144 and the CPU 10 determines whether or not a prescribed time has elapsed. The CPU 10 counts a timer signal supplied from the timer 50, and determines whether or not the prescribed time has elapsed from the time when the operation button 30 was finally operated. It returns to the step S142 to enter a standby state for subsequent button operation when the prescribed time has not elapsed, while advancing to a step S148 when the prescribed time has elapsed for switching the display state in the display part 20 to a display state of the purport that it is a feature data registration state, thereafter returning to the step S130 for entering the locked state by registration of the feature data again and entering a button operation standby state for input of an image.

Also in a case where an image having a feature matching with the registered feature data is input, therefore, it follows that the CPU 10 automatically returns to the locked state when the specific user performs no button operation over the prescribed time. Even if the specific user performs image input operation, performs button operation for operation setting of the air conditioner 100*a* with the remote controller 1*a* and thereafter leaves the remote controller 1*a* in this state, therefore, it is possible to prevent the set contents from being changed by another person.

When employing the aforementioned remote controller 1*a*, it is possible to set the remote controller 1*a* in the locked state by registering the feature data indicating the feature of the specific user in the remote controller 1*a* itself, it is possible to inhibit a person other than the specific user from operating the remote controller 1*a* and changing the operating state of the air conditioner 100*a*, and it becomes possible to perform controlled air conditioning management.

It is also effective in a point that the specific user may not commit a password or the like in memory when employing the aforementioned remote controller 1*a*.

While the case of expressing the feature of the user as the feature data from the image data of the fingerprint, the eyeball, the face or the like and performing setting of the locked state and releasing of the locked state on the basis of the feature data has been described in the above description, it may be so structured as to simply store the image data of the fingerprint, the eyeball, the face or the like in the memory 40 as such and perform image comparison with an image input in remote controller operation thereby determining whether or not it is the specific user and releasing the locked state.

While the case of inputting the characteristic part in the human body as the image data and generating the feature data therefrom has been described in the above description, the input image data may not be the image data related to the body of the specific user. For example, a signature of the user's own handwriting or the like may be input as an image so that the CPU 10 performs handwriting analysis thereby performing determination as to whether or not it is the specific user. In this case, the image input part 70 in the aforementioned remote controller 1*a* may be structured by a scanner for reading a signature handwritten on a paper surface or the like, while it is also possible to employ a structure structuring the image input part 70 by a pen input device or the like so that the user directly makes handwriting with respect to the image input part 70.

<Third Embodiment>

A third embodiment is now described. In this embodiment, a structure previously storing card information of an identification card, a credit card, a driver's license, a staff card or the like possessed by a specific user to be capable of changing/operating an operating state of an air conditioner with a remote controller when card information input from a card reader in remote controller operation and the previously stored card information match is described.

Figure 9:
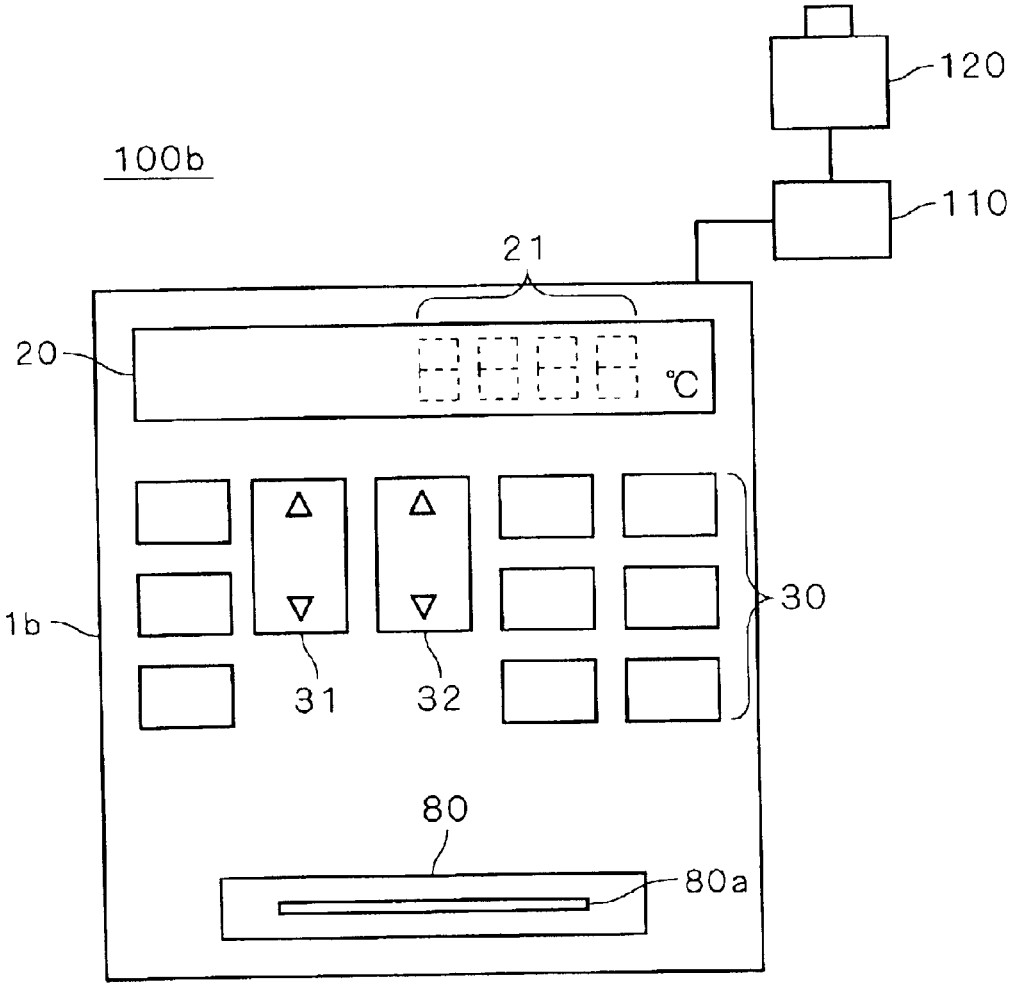
FIG. 9 is a diagram showing an air conditioner in a third embodiment.

FIG. 9 is a diagram showing an air conditioner 100*b* in the third embodiment. The air conditioner 100*b* comprises a remote controller 1*b*, an indoor unit 110 and an outdoor unit 120, and is structured to be capable of remotely setting set contents of an operating state for air conditioning by the indoor unit 110, the outdoor unit 120 or the like from the remote controller 1*b*.

The remote controller 1*b* has a structure substantially similar to the remote controller 1 in the first embodiment, and the same numerals are assigned as to structural members similar to the structural members described in the first embodiment also in FIG. 9.

The remote controller 1*b* comprises a display part 20 and a plurality of operation buttons 30, and a card reader 80 reading card information stored in or printed on a card such as an identification card, a credit card, a driver's license, a staff card or the like is provided on a lower side of the plurality of operation buttons 30. When the card is inserted in a card slot 80*a*, this card reader 80 electrically, electromagnetically or optically reads a prescribed part of the card thereby generating card information structured by a numeral string or a character string. The card information read by the card reader 80 is desirably information specific to the card, and information capable of specifying the owner of the card.

Figure 10:
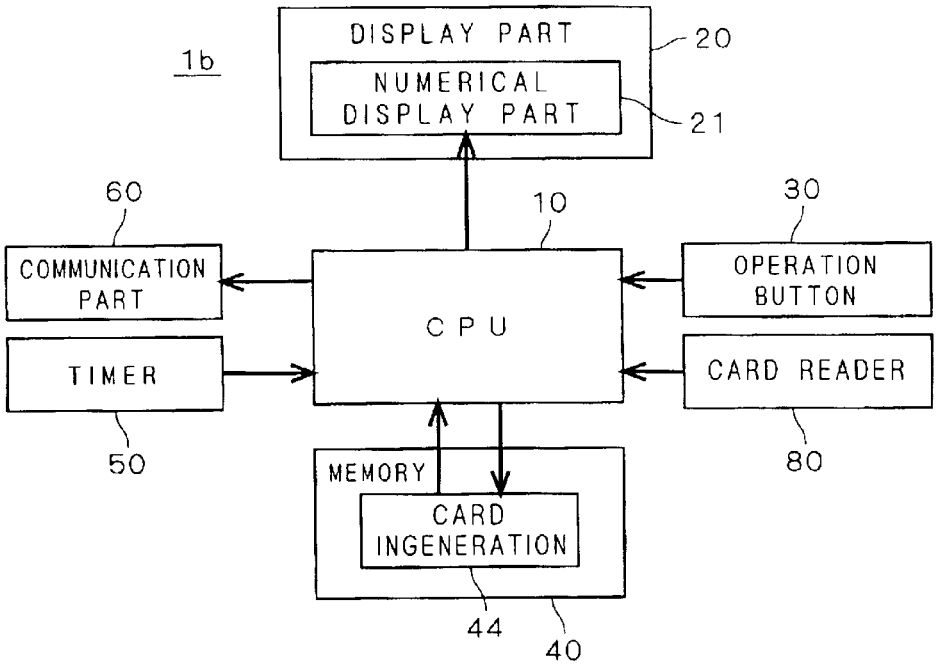
FIG. 10 is a block diagram showing the internal structure of a remote controller in the third embodiment.

FIG. 10 is a block diagram showing the internal structure of the remote controller 1*b*. As shown in FIG. 10, the remote controller 1*b* is structured while comprising a CPU 10, the display part 20, the operation buttons 30, a memory 40, a timer 50, a communication part 60 and the card reader 80.

The card reader 80 is so structured as to supply the card information to the CPU 10 when the card is inserted and it generates the card information.

The CPU 10 sets the remote controller 1*b* in a locked state or releases the locked state on the basis of the card information input from the card reader 80. That is, the CPU 10 has a function of previously registering card information 44 of the card possessed by the specific user, while having a function of making it impossible to perform operation of setting/changing an operating state or the like of the air conditioner 100*b* without inserting the card whose card information matches in the card reader 80 when the card information is registered.

When insertion of the card whose card information matches is performed in the case where the card information 44 is registered, on the other hand, the CPU 10 accepts operation of setting/changing the operating state etc. of the air conditioner 100*b* performed in continuation thereto as a valid one, and comes to perform control operation of the air conditioner 100*b* such as that transmitting a control signal corresponding to the operated operation button 30 to the indoor unit 110 or the like.

When card information of a card inserted by the user in remote controller operation does not match with the registered card information 44 in the case where the card information 44 is registered, the CPU 10 does not accept setting/changing of the operating state etc. of the air conditioner 100*b* performed in continuation thereto.

That is, the CPU 10 functions as control means determining whether or not there has been input of an image matching with the registered card information 44 when operational input related to operation setting of the air conditioner 100*b* is performed, thereby determining whether to validate or invalidate operation setting input in the remote controller 1*b*.

The memory 40 is storage means for registering (storing) the card information 44 in the remote controller 1*b*. When the specific user previously inserts the card possessed by him(her)self into the card reader 80 with respect to the remote controller 1*b*, the card reader 80 reads the card information of the card while the CPU 10 stores the card information in the memory 40, whereby registration of the card information 44 is performed.

When the card information 44 is registered in the memory 40, the CPU 40 is structured to perform comparison of the card information input from the card reader 80 and the card information 44 stored in the memory 40 and make determination as to whether or not to release locking.

Figure 11:
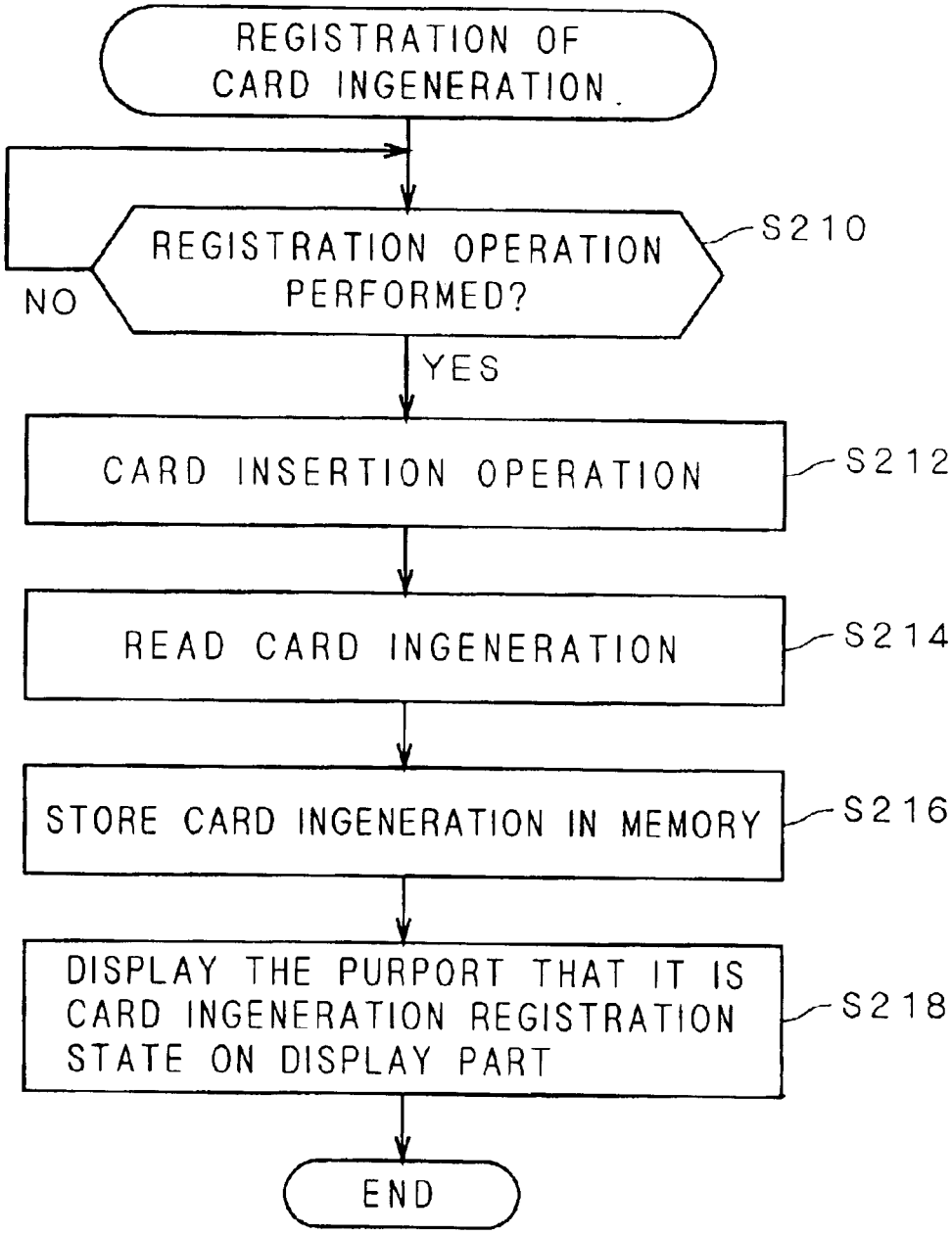
FIG. 11 is a flow chart showing a procedure on the occasion of registering card information.

A procedure in the case of registering the card information of the card possessed by the specific user with respect to the remote controller 1*b* is now described. FIG. 11 is a flow chart showing the procedure on the occasion of registering the card information.

First, the CPU 10 determines whether or not specific registration operation for registering the card information of the specific user has been performed with respect to the remote controller 1*b* (step S210).

When no specific operation is performed, it does not advance to processing for registering the card information. When no feature data is set on the remote controller 1*b*, it follows that the remote controller 1*b* performs operation similar to that of a general remote controller, and a person other than the specific user can perform remote controller operation for changing operation setting or the like of the air conditioner 100*b*. When the user operates the remote controller 1*b* in this case, therefore, the CPU 10 generates a control signal responsive to the operation contents and transmits the same to the indoor unit 110 or the like thereby performing operation control of the air conditioner 100*b*.

When the specific operation is performed, on the other hand, it enters a state waiting for insertion of the card possessed by the specific user into the card reader 80, and when insertion of the card into the card reader 80 is performed (step S212), the card reader 80 reads the information of the card (step S214). The CPU 10 makes the memory 40 store the card information input from the card reader 80 (step S216).

Thus, it follows that the card information 44 has been registered in the remote controller 1*b*, and hence the CPU 10 displays the purport that it is a state where the card information is registered with respect to the display part 20 (step 218). This display may be display of the purport that it is a locked state. Thus, the user can grasp that the card information has been registered in the remote controller 1*b* and it is the locked state where remote controller operation by a person other than the specific user is inhibited.

Figure 12:
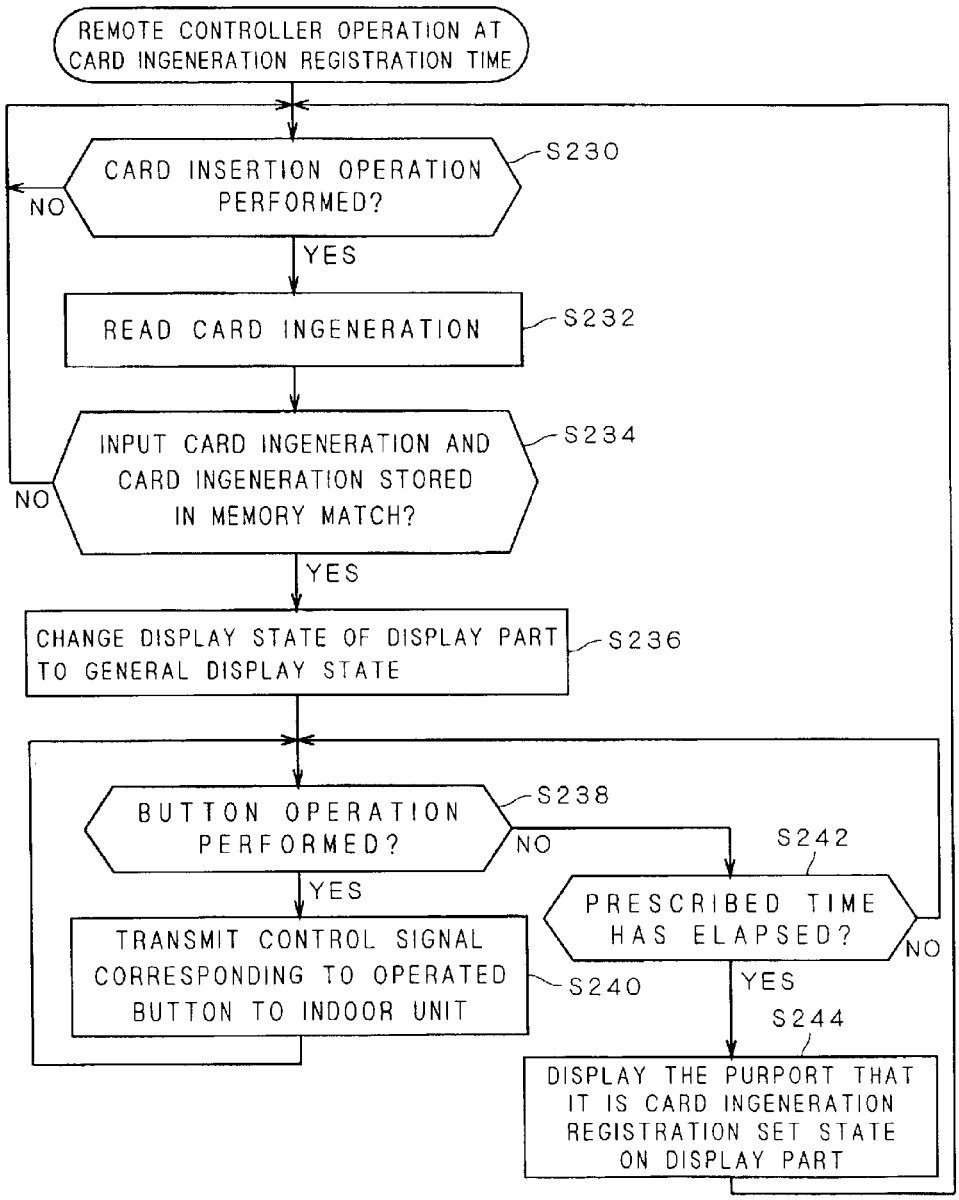
FIG. 12 is a flow chart showing a procedure in a card information registration state.

A procedure in the case of performing remote controller operation in the card information registration state is now described. FIG. 12 is a flow chart showing the procedure at a card information registration time.

When shifting to the state where the card information is registered, the CPU 10 enters a state waiting for insertion of the card into the card reader 80 (step S230), and advances to a step S232 when button operation is performed. When card insertion operation is performed by the user, the card reader 80 reads the card information in response thereto, and supplies the card information to the CPU 10 (step S232).

Then, the CPU 10 reads the previously registered card information 44 from the memory 40, and makes determination as to whether or not the card information obtained by the step S232 matches with the registered card information 44 (step S234). When the card information of the inserted card and the card information 44 registered in the memory 40 do not match at this point of time, it returns to the step S230 to enter the state waiting for insertion of the card again while the locked state is maintained.

When the card information of the inserted card and the registered card information 44 match, on the other hand, it is estimable that the operator of the remote controller 1*b* is the same person as the specific user, and hence it advances to a step S236 for enabling general remote controller operation and enters an unlocked state.

The CPU 10 switches the display state of the display part 20 from the display of the card information registration state to display for the general remote controller operation (step S236). Thus, the specific user can properly perform operation setting or the like of the air conditioner 100*b* while visually recognizing the display part 20. Then, it advances to a step S238, and determines whether or not button operation of the remote controller 1*b* has been performed. It advances to a step S240 when the button operation has been performed, while advancing to a step S242 when no operation has been performed.

At the step S240, the CPU 10 generates a control signal corresponding to the operated operation button 30 and makes communication with the indoor unit 110 or the like, thereby validating the contents of operation setting by remote controller operation such as change of a preset temperature in the air conditioner 100*b*. When operation setting or the like responsive to the button operation is performed, it comes to return to the step S238 again.

When no button operation has been performed in the determination at the step S238, it advances to the step S242 and the CPU 10 determines whether or not a prescribed time has elapsed. The CPU 10 counts a timer signal supplied from the timer 50, and determines whether or not the prescribed time has elapsed from the time when the operation button 30 was finally operated. It returns to the step S238 to enter a standby state for subsequent button operation when the prescribed time has not elapsed, while advancing to a step S244 when the prescribed time has elapsed for switching the display state in the display part 20 to the display state of the purport that it is the card information registration state, thereafter returning to the step S230 for entering the locked state by registration of the card information again and entering a card insertion standby state.

Also in a case where a card whose registered card information matches is inserted in the card reader 80, therefore, it follows that the CPU 10 automatically returns to the locked state when the specific user performs no button operation over the prescribed time. Even if the specific user performs card insertion operation, performs button operation for operation setting of the air conditioner 100*b* with the remote controller 1*b* and thereafter leaves the remote controller 1*b* in this state, therefore, it is possible to prevent the set contents from being changed by another person.

When employing the aforementioned remote controller 1*b*, it is possible to set the remote controller 1*b* in the locked state by registering the card information of the card possessed by the specific user in the remote controller 1*b* itself, it is possible to inhibit a person other than the specific user from operating the remote controller 1*b* and changing the operating state of the air conditioner 100*b*, and it becomes possible to perform controlled air conditioning management.

Further, it is also effective in a point that the specific user may not commit a password or the like in memory when employing the aforementioned remote controller 1*b*.

While the case of registering the card information of the identification card, the credit card, the driver's license, the staff card or the like possessed by the specific user and setting the remote controller 1*b* in the locked state and releasing the locked state on the basis of the card information has been described in the above description, it may be so structured as to perform setting of the locked state and releasing of the locked state with a recording medium such as a dedicated card with respect to the remote controller 1*b*, for example.

<Fourth Embodiment>

A fourth embodiment is now described. In this embodiment, a structure previously storing voiceprint data of a specific user to be capable of changing/operating an operating state of an air conditioner by a remote controller when the voiceprint of a voice input from a voice input part such as a microphone in remote controller operation matches with the contents of the previously stored voiceprint data.

Figure 13:
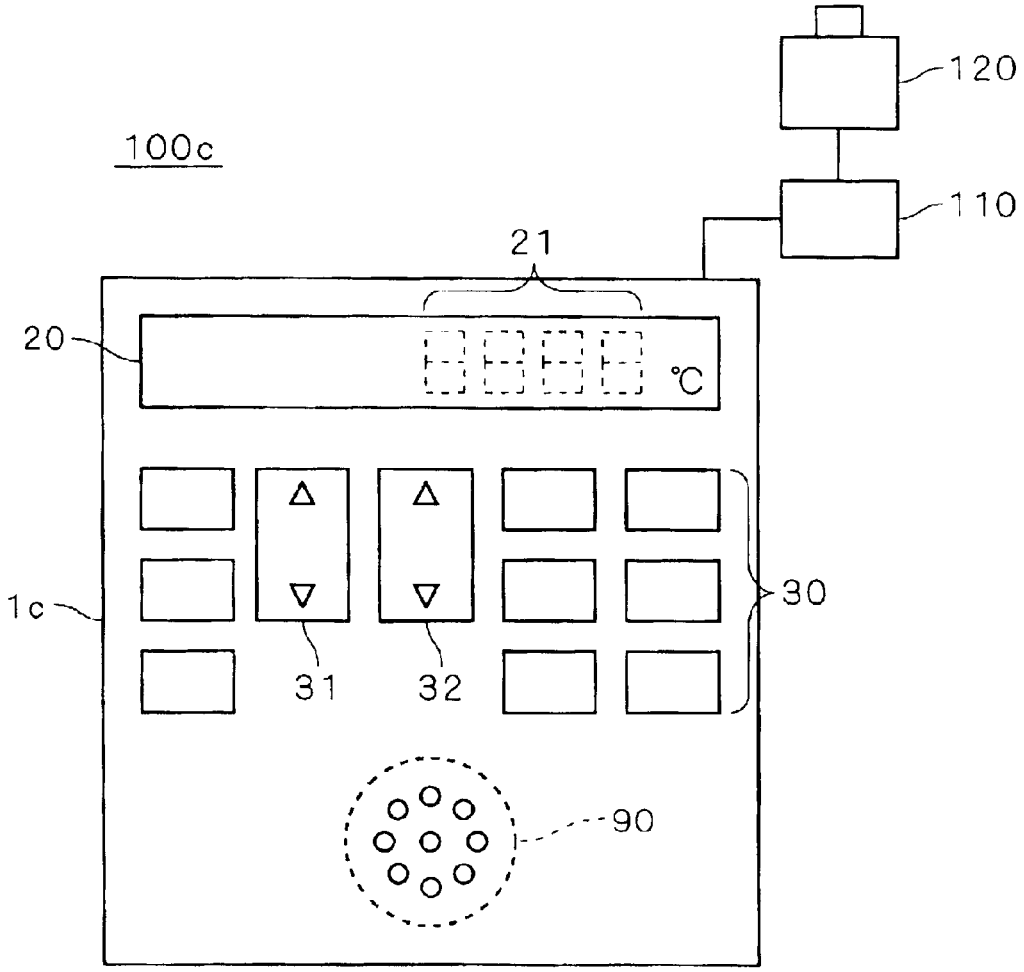
FIG. 13 is a diagram showing an air conditioner in a fourth embodiment.

FIG. 13 is a diagram showing an air conditioner 100*c* in the fourth embodiment. The air conditioner 100*c* comprises a remote controller 1*c*, an indoor unit 110 and an outdoor unit 120, and is structured to be capable of remotely setting the set contents of an operating state for air conditioning by the indoor unit 110, the outdoor unit 120 or the like from the remote controller 1*c*.

The remote controller 1*c* has a structure substantially similar to the remote controller 1 in the first embodiment, and the same numerals are assigned as to structural members similar to the structural members described in the first embodiment also in FIG. 13.

The remote controller 1*c* comprises a display part 20 and a plurality of operation buttons 30, and a microphone 90 defining a voice input part is provided on a lower side of the plurality of operation buttons 30.

Figure 14:
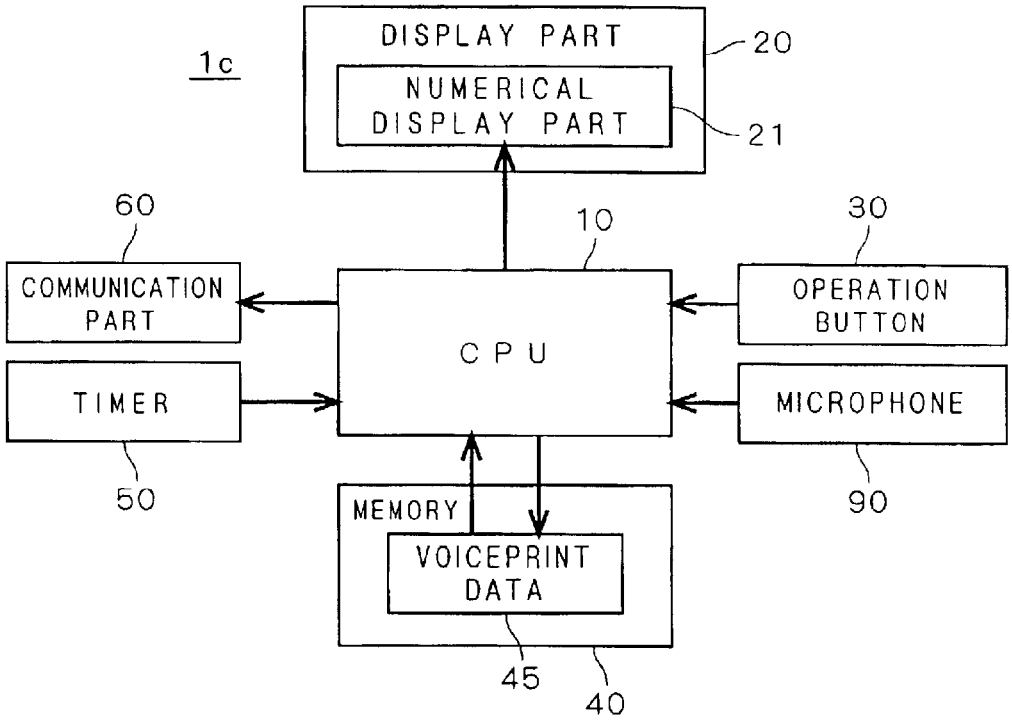
FIG. 14 is a block diagram showing the internal structure of a remote controller in the fourth embodiment.

FIG. 14 is a block diagram showing the internal structure of the remote controller 1*c*. As shown in FIG. 14, the remote controller 1*c* is structured while comprising a CPU 10, the display part 20, the operation buttons 30, a memory 40, a timer 50, a communication part 60 and the microphone 90.

The microphone 90 is an apparatus converting an input voice to an electric voice signal, and the voice signal generated in the microphone 90 is supplied to the CPU 10.

The CPU 10 analyzes the voice signal input from the microphone 90, and generates voiceprint data of the voice signal. The CPU 10 has a function of previously registering voiceprint data 45 related to the specific user, while having a function of making it impossible to perform operation of set changing of the operating state or the like of the air conditioner 100*c* without performing input of a voice whose voiceprint matches when the voiceprint data 45 is registered.

When input of a voice whose voice print matches is performed in the case where the voiceprint data 45 is registered, on the other hand, the CPU 10 accepts operation of set changing of the operating state or the like of the air conditioner 100*c* performed by the user in continuation to the voice input as a valid one and comes to perform control operation of the air conditioner 100*c* such as that transmitting a control signal corresponding to the operated operation button 30 to the indoor unit 110 or the like.

When the voiceprint data 45 is registered in a case where the feature of a voice uttered by the user in remote controller operation does not match with the registered voiceprint data, the CPU 10 does not accept set changing of the operating state or the like of the air conditioner 100*c* input in continuation thereto.

That is, the CPU 10 functions as control means determining whether or not there has been input of a voice matching with the voiceprint data 45 when operational input related to operation setting of the air conditioner 100*c* is performed, thereby determining whether to validate or invalidate operation setting input in the remote controller 1*c*.

The memory 40 is storage means for registering (storing) the voiceprint data 45 in the remote controller 1*c*. When the specific user previously inputs the voice with respect to the remote controller 1*c*, the CPU 10 analyzes the voice to generate the voiceprint data and stores the same in the memory 40, whereby registration of the voiceprint data is performed.

Figure 15:
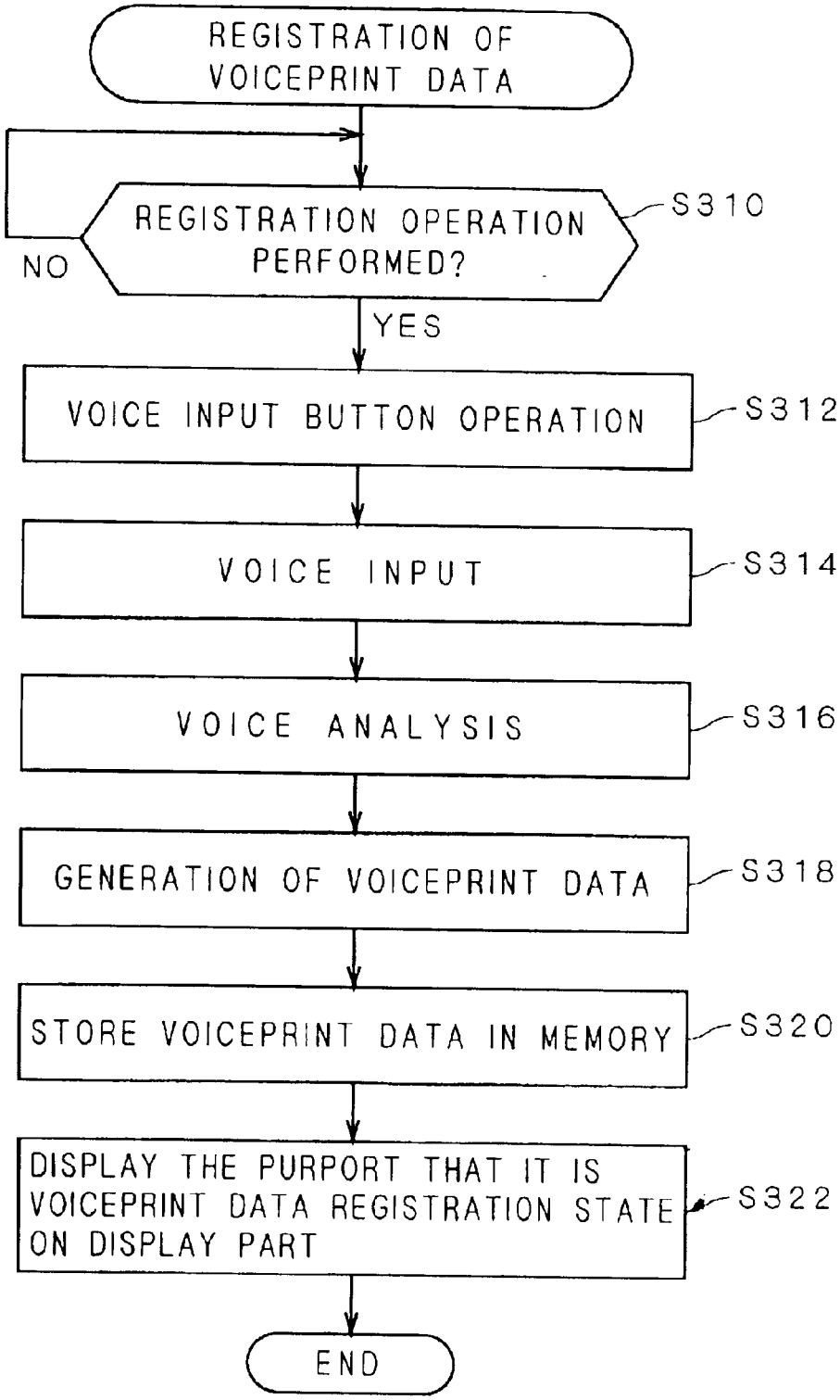
FIG. 15 is a flow chart showing a procedure on the occasion of registering voiceprint data of a specific user.

A procedure in the case of registering the voiceprint data of the specific user with respect to the remote controller 1*c* is now described. FIG. 15 is a flow chart showing the procedure on the occasion of registering the voiceprint data of the specific user.

First, the CPU 10 determines whether or not specific operation for registering the voiceprint data of the specific user has been performed with respect to the remote controller 1*c* (step S310).

When no specific operation is performed, it does not advance to processing for registering the voice data. When the voice data is not set on the remote controller 1*c*, it follows that the remote controller 1*c* performs operation similar to that of a general remote controller, and a person other than the specific user can perform remote controller operation for changing operation setting or the like of the air conditioner 100*c*. When the user operates the remote controller 1*c* in this case, therefore, the CPU 10 generates a control signal responsive to the operation contents and transmits the same to the indoor unit 110 or the like thereby performing operation control of the air conditioner 100*c*.

When the specific operation is performed, on the other hand, it enters a state waiting for voice input from the microphone 90, and when operation of a voice input button included in the operation buttons 30 is performed by the user (step S312), the CPU 10 performs sampling of a voice signal input from the microphone 90 in response thereto and inputs the voice signal (step S314). The CPU 10 analyzes the input voice signal (step S316), generates the voiceprint data of the voice (step S318), and makes the memory 40 store the voiceprint data (step S320).

Thus, it follows that the voiceprint data 45 has been registered in the remote controller 1*c*, and hence the CPU 10 displays the purport that it is the state where the voiceprint data is registered with respect to the display part 20 (step 322). This display may be display of the purport that it is in a locked state. According to this display, the user can grasp that the voiceprint data is registered in the remote controller 1*c* and it is the locked state where remote controller operation by a person other than the specific user is inhibited.

Registration processing of the voiceprint data in the remote controller 1*c* terminates in the above manner.

Figure 16:
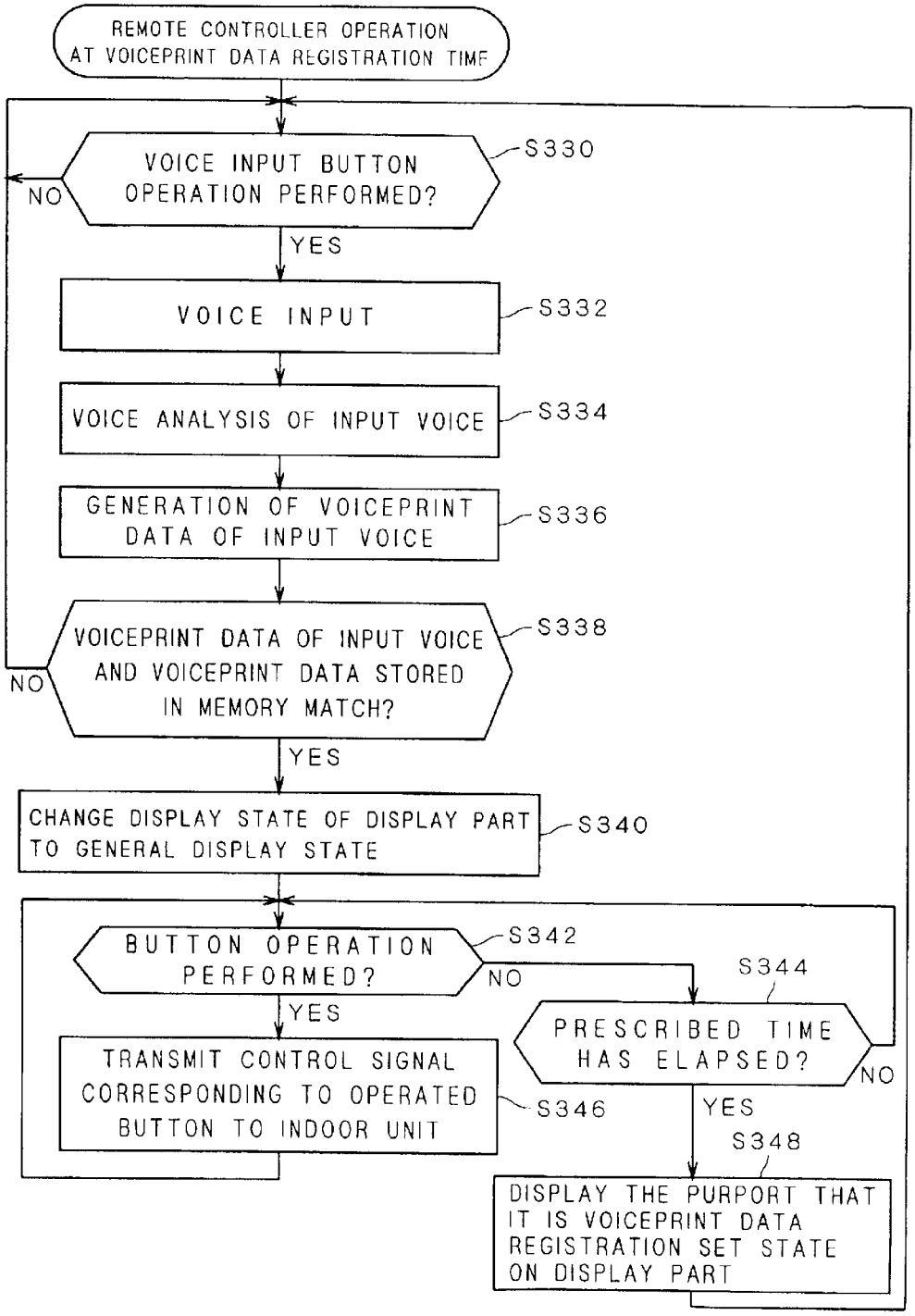
FIG. 16 is a flow chart showing a procedure at a voiceprint data registration time.

A procedure in the case of performing remote controller operation in the voiceprint data registration state is now described. FIG. 16 is a flow chart showing the procedure at a voiceprint data registration time.

When shifting to the state where the voiceprint data is registered, the CPU 10 enters a state waiting for operation of the voice input button (step S330), and advances to a step S332 when button operation is performed.

When operation of the voice input button is performed by the user, the CPU 10 inputs the voice signal from the microphone 90 in response thereto (step S332). The CPU 10 performs voice analysis of the input voice (step S334), and generates the voiceprint data of the input voice (step S336).

Then, the CPU 10 reads the previously registered voiceprint data 45 from the memory 40, and makes determination as to whether or not the voiceprint data of the input voice obtained by the step S336 matches with the registered voiceprint data 45 (step S338). When the voiceprint data of the input voice and the registered voiceprint data 45 do not match at this point of time, it returns to the step S330 to enter the standby state for the voice input again while the locked state is maintained.

When the voiceprint data of the input voice and the registered voiceprint data 45 match, on the other hand, it is estimable that the operator of the remote controller 1*c* is the same person as the specific user, and hence it advances to a step S340 for enabling general remote controller operation and enters an unlocked state.

The CPU 10 switches the display state of the display part 20 from the display of the voiceprint data registration state to display for the general remote controller operation (step S340). Thus, the specific user can properly perform operation setting or the like of the air conditioner 100*c* while visually recognizing the display part 20. Then, it advances to a step S342, and determines whether or not button operation of the remote controller 1*c* has been performed. It advances to a step S346 when the button operation has been performed, while advancing to a step S344 when no operation has been performed.

At the step S346, the CPU 10 generates a control signal corresponding to the operated operation button 30 and makes communication with the indoor unit 110 or the like, thereby validating the contents of operation setting by remote controller operation such as change of a preset temperature in the air conditioner 100*c*. When operation setting or the like responsive to the button operation is performed, it comes to return to the step S342 again.

When no button operation has been performed in the determination at the step S342, it advances to the step S344 and the CPU 10 determines whether or not a prescribed time has elapsed. The CPU 10 counts a timer signal supplied from the timer 50, and determines whether or not the prescribed time has elapsed from the time when the operation button 30 was finally operated. It returns to the step S342 to enter a standby state for subsequent button operation when the prescribed time has not elapsed, while advancing to a step S348 when the prescribed time has elapsed for switching the display state in the display part 20 to a display state of the purport that it is a voiceprint data registration state, thereafter returning to the step S330 for entering the locked state by registration of the voiceprint data again and entering a button operation standby state for input of a voice.

Also in a case where a voice matching with the registered voiceprint data is input, therefore, it follows that the CPU 10 automatically returns to the locked state when the specific user performs no button operation over the prescribed time. Even if the specific user performs voice input operation, performs button operation for operation setting of the air conditioner 100*c* with the remote controller 1*c* and thereafter leaves the remote controller 1*c* in this state, therefore, it is possible to prevent the set contents from being changed by another person.

When employing the aforementioned remote controller 1*c*, it is possible to set the remote controller 1*c* in the locked state by registering the voiceprint data of the specific user in the remote controller 1*c* itself, it is possible to inhibit a person other than the specific user from operating the remote controller 1*c* and changing the operating state of the air conditioner 100*c*, and it becomes possible to perform controlled air conditioning management.

It is also effective in a point that the specific user may not commit a password or the like in memory when employing the aforementioned remote controller 1*c*.

The example so structured that the CPU 10 determines the voiceprint of the input voice thereby determining whether or not this is the specific user has been described in the above description, the same may be so structured that the CPU 10 performs voice recognition for determining whether or not a specific word has been uttered as a voice thereby determining whether or not this is the specific user. In this case, however, the specific user must commit the specific word in memory.

<Modification>

While some embodiments related to the present invention have been described, the present invention is not restricted to the contents of the above description.

While the examples of setting the remote controllers in the locked states or the unlocked states with the password, the feature data, the card information and the voiceprint data etc. have been described in the aforementioned respective embodiments, for example, it is not restricted to the password, the feature data, the card information and the voiceprint data but the remote controller can be set in the locked state or the unlocked state with arbitrary identification information.

Further, it may be so structured as to store the identification information such as the password, the feature data, the card information and the voiceprint data in the aforementioned respective embodiments in the memory 40 in plural, so that a plurality of specific users can operate the remote controller.

As to a case of adding, changing or deleting the identification information stored in the memory 40 in each of the aforementioned embodiments, it may be so structured that the specific user can perform this operation by performing specific operation with respect to the remote controller.

While the case where the air conditioner comprises the single indoor unit 110 and the single outdoor unit 120 has been illustrated in each of the aforementioned embodiments, it is not restricted to this but a plurality of indoor units and a plurality of outdoor units may be provided respectively.

While the invention has been described in detail, the foregoing description is in all aspects illustrative and the invention is not restricted thereto. It is understood that unillustrated numerous modifications can be devised without departing from the scope of the invention.

We claim:

1. A remote controller (1, 1*a*, 1*b*, 1*c*) for an air conditioner comprising:

storage means (40) storing identification information (41, 43, 44, 45);

input means (30, 70, 80, 90) for inputting information;

control means (10) validating operational input related to operation setting of said air conditioner only when information matching with said identification information is input from said input means when said identification information is stored in said storage means; and display means (20) displaying the purport that setting of said identification information is carried out when said identification information is stored in said storage means.

2. The remote controller for an air conditioner according to claim 1, wherein said control means (10) switches the display contents in said display means (20) from the display contents of the purport that said setting of said identification information is carried out to general display contents for operational input when input of information matching with said identification information (41, 43, 44, 45) is performed from said input means.

3. The remote controller for an air conditioner according to claim 2, wherein said control means (10) switches the display contents in said display means (20) from said general display contents to the display contents of the purport that said setting of said identification information is carried out when a prescribed time has elapsed from final operational input after switching the display contents in said display means (20) to said general display contents.

4. An air conditioner comprising the remote controller for an air conditioner according to any of claims 1 through 3.

* * * * *